US007093670B2

(12) United States Patent
Saito et al.

(10) Patent No.: US 7,093,670 B2
(45) Date of Patent: Aug. 22, 2006

(54) IMPACT DRILL

(75) Inventors: Takuma Saito, Hitachinaka (JP); Shinki Ohtsu, Hitachinaka (JP); Jyunichi Toukairin, Hitachinaka (JP); Kenji Kataoka, Hitachinaka (JP); Kazuhide Ohzeki, Hitachinaka (JP); Shigeru Ishikawa, Hitachinaka (JP); Hideki Watanabe, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/912,098

(22) Filed: Aug. 6, 2004

(65) Prior Publication Data

US 2005/0028995 A1 Feb. 10, 2005

(30) Foreign Application Priority Data

Aug. 6, 2003 (JP) ..... P2003-206234
Aug. 6, 2003 (JP) ..... P2003-206249

(51) Int. Cl.
*B25D 17/00* (2006.01)

(52) U.S. Cl. ..... 173/91; 173/93; 173/93.5; 173/162.2

(58) Field of Classification Search ..... 173/93, 173/93.5, 162.2, 201, 48, 210, 211, 91
See application file for complete search history.

(56) References Cited

U.S. PATENT DOCUMENTS 3,736,992 A * 6/1973 Zander et al. ..... 173/48
4,098,351 A 7/1978 Alessio
4,158,970 A * 6/1979 Laughon ..... 74/526
4,282,938 A 8/1981 Minamidate
4,442,906 A * 4/1984 Simpson ..... 173/48
4,446,931 A * 5/1984 Bleicher et al. ..... 173/48
4,567,950 A * 2/1986 Fushiya et al. ..... 173/48
5,711,379 A 1/1998 Amano et al.
5,820,312 A 10/1998 Stock et al.
5,996,708 A * 12/1999 Gerold ..... 173/211
6,089,330 A * 7/2000 Miescher et al. ..... 173/132
6,138,772 A * 10/2000 Miescher et al. ..... 173/93.5
6,196,330 B1 * 3/2001 Matthias et al. ..... 173/48
6,230,819 B1 * 5/2001 Chen ..... 173/48
2005/0028996 A1 2/2005 Toukairin et al.

FOREIGN PATENT DOCUMENTS

| | | |
|---|---|---|
| EP | 0 623 427 | 11/1994 |
| EP | 1 448 343 | 8/2004 |
| JP | 2-30169 | 8/1990 |
| JP | 8-323520 | 12/1996 |
| JP | 3002284 | 11/1999 |
| WO | WO2004/020156 | 3/2004 |

* cited by examiner

*Primary Examiner*—John Sipos
*Assistant Examiner*—Nathaniel Chukwurah
(74) *Attorney, Agent, or Firm*—Antonelli, Terry, Stout and Kraus, LLP.

(57) ABSTRACT

An impact drill minimizing transmission of vibration to a handle gripped by a user's hand. A spindle extends through a main frame and is movable in its axial direction and rotatable about its axis. A first ratchet is rotatable and axially movable together with the spindle. A second ratchet is axially movable but unrotatable. In an impact drilling mode, the first ratchet is brought into abutment with the second ratchet so that the spindle is reciprocally moved in the axial direction.

16 Claims, 9 Drawing Sheets

IMPACT DRILL

BACKGROUND OF THE INVENTION

The present invention relates to an impact drill for boring a hole in a concrete, mortar and tiles, and more particularly, to such impact drill providing a drilling mode in which a boring is performed by rotating a drill bit and a impact drilling mode in which boring is performed by rotating and impacting or vibrating the drill bit.

A conventional impact drill of this type is shown in FIGS. 15 through 18. A main frame 401 includes a gear cover 417, an inner cover 418, an outer cover 419, a housing 407, and a handle portion 406 connected thereto, those defining an outer configuration of the drill and housing therein various components at given positions. A spindle 402 extends through the gear cover 417, and a drill chuck 3 is attached to a front end of the spindle 402. The spindle 402 has an intermediate portion provided with a rotatable ratchet 404 rotatable together with the rotation of the spindle 402 and movable together with an axial displacement of the spindle 402. The rotatable ratchet 404 has one side 404*a* formed with a serration or alternating projections and recesses.

A fixed ratchet 405 is disposed in confrontation with the rotatable ratchet 404, and has a side 405*a* formed with a serration or alternating projections and recesses. The fixed ratchet 405 has a hollow cylindrical shape and is fixed at a position regardless of the rotation and axial displacement of the spindle 402.

Meanwhile, a motor 408 is disposed within the housing 407. The rotational driving force of the motor 408 is transmitted through a rotary shaft 409 to a gear 410. The gear 410 is force-fitted into a pinion 411, so the aforementioned rotational driving force is transferred to the pinion 411. The pinion 411 has two pinions 411*a* and 411*b* those having numbers of teeth different from each other and which are meshedly engaged with a low speed gear 412 and a high speed gear 413, respectively. When the pinion 411 rotates, the gears 412 and 413 rotate as well. These gears 412 and 413 are formed with concave portions.

A clutch disc 414 is disposed over and engages the spindle 402, and is slidable in an axial direction thereof. As shown in FIG. 1, when the clutch disc 414 is slidingly moved and pressed into the concave portion of the low speed gear 412, the rotation of the pinion 411 is transferred to the spindle 402 through the low speed gear 412 and the clutch disc 414. On the other hand, if the clutch disc 414 slides rightward from the position in FIG. 15, and when inserted into the concave portion of the high speed gear 413, the rotation of the pinion 411 is transferred to the spindle 402 through the high speed gear 413 and the clutch disc 414. Consequently, the spindle 402 can be given low-speed rotation or high-speed rotation based on the movement of the clutch disc 414.

A change lever 415 is provided for changing operation mode of the impact drill between a drilling mode and an impact drilling mode. A change shaft 416 is force-fitted into the change lever 415. By rotating the change lever 415 about its rotation axis, the change shaft 416 is rotated about its axis along with the change lever 415. As shown in FIGS. 16 through 18, the change shaft 416 is formed with a notch 416*a*. The impact drill operates in drilling mode when the notch 416*a* is in the position in FIG. 16, and operates in impact drilling mode when the notch 416*a* is in the position in FIG. 17.

Drilling mode will be described. If the bit (not shown) attached to the drill chuck 403 is brought into contact with a workpiece (not shown), and the handle 406 is pressed in the direction of the arrow in FIG. 15, and if the notch 416*a* in the change shaft 416 is in the position shown in FIG. 16, an internal end of the spindle 402 will abut against the outer peripheral surface of the change shaft 416 and will not be able to move rightward any more. As a result, the contoured serrated surface 404*a* of the rotation ratchet 404 and the contoured serrated surface 405*a* of the fixed ratchet 405 will not come into contact. Consequently, the rotational driving force of the motor 408 is transferred through the low speed gear 412 or the high speed gear 413 to the spindle 402, and only the rotational force is imparted to the bit.

In case of the impact drilling mode, the change lever 415 is rotated about its axis so as to displace the position of the notch 416*a* in the change shaft 416 to the position shown in FIG. 17. In this state, if the bit attached to the drill chuck 403 is brought into contact with the workpiece, and if the handle 406 is pressed in the direction of the arrow in FIG. 15, the inner end of the spindle 402 will enter the notch 416*a* as shown in FIG. 18. In other words, since the spindle 402 can be moved rightward slightly, the contoured surface 404*a* of the rotation ratchet 404 resultantly comes into contact with the contoured surface 405*a* of the fixed ratchet 405.

When drilling into the workpiece, if the spindle 402 is rotated in the state shown in FIG. 18, the rotatable ratchet 404 engages the fixed ratchet 405, so that vibration is generated by the pressure contact between the alternating projections and recesses of the serrated surfaces 404*a*, 405*a* of both of the ratchets 404 and 405, and this vibration is transmitted through the spindle 202 to the bit (not shown). In other words, rotational force and vibration are imparted to the bit, and drilling is performed by the combined rotational force and the vibration force.

However, when the vibration drill described above is operated in the impact drilling mode, the vibration is transferred not only to the bit, but also to the handle 406 by way of the fixed ratchet 405, the inner cover 418 and the housing 407. This leads to the problem that a large amount of vibration is passed to users of the impact drill, thus causing discomfort. In particular, if the impact drill is used continuously for long periods of time, caution must be exercised such that there are no adverse effects on the health of users.

Several proposals have been made for mechanisms to reduce the vibration passed to the users. For example, according to laid open Japanese utility model application publication No. S59-9808, as shown in FIG. 19, a spindle 520 is rotatably and axially movably supported to a housing through a bearing 511. A rotation cam 521 is fixed to the spindle 520, so that the rotation cam 521 is rotated together with the rotation of the spindle 520 and movable together with the spindle 520. A serrated contour is formed on a cam surface 521*a* of the rotation cam 521.

A clutch cam 522 is supported on a spindle 520 and is slidably movable in the axial direction of the spindle 520. The clutch cam 522 includes a hollow cylindrical section slidable with respect to the spindle 520, and a flange section 522*b*. A serrated contour is formed on a cam surface 522*c* of the flange section 522*b*. Further, a regulation slot 522*a* is formed at an outer peripheral surface at a position near a rear end portion 522*d* of the hollow cylindrical section. A plate 524 extending perpendicular to the spindle 520 is engaged with the regulation slot 522*a*. A spring 523 is interposed between the flange section 522*b* and the plate 524.

The spring 523 continuously urges the clutch cam 522 toward the rotation cam 521, and the cam surfaces 521*a* and 522*c* are pressed together when the spindle 520 is retracted into the housing. Then, when the force applied to the spindle 520 surpasses the biasing force of the spring 523, the spring 523 is compressed and the clutch cam 522 retracts (moves rightward in FIG. 19). However, the displacement of the clutch cam 522 is limited within a length of the slot 522*a*. When the clutch cam 522 moves forward from the retracted position by the biasing force of the spring 523, the clutch cam 522 strikes against the rotation cam 521, and the rotation cam 521 vibrates along with the spindle 520.

Since the vibration arising from the contact between the cam surfaces 521*a* and 522*c* is alleviated by the spring 523 before being transmitted to a handle (not shown), the mechanism shown in FIG. 19 is advantageous in reducing the transmission of vibration to the user in comparison with the mechanism shown in FIG. 15 where the ratchet 405 is placed in a fixed position.

SUMMARY OF THE INVENTION

However, the present inventors have found the drawbacks in the structure shown in FIG. 19. That is, since the clutch cam 522 moves backward and forward repeatedly across the length of the slot 522*a* engaged with the plate 524, the rear end 522*d* of the clutch cam 522 repeatedly strikes against the plate 524.

Consequently, the problems arise that the transfer of the vibration arising in this part to the handle still cannot be avoided, and furthermore that the rear end 522*d* or the plate 524 will be prone to breaking due to mechanical fatigue. In addition, if the function of the spring 523 is insufficient, the spindle 520 or the clutch cam 522 would strike against the rear part, and the transfer of the vibration to the handle could not be avoided, if even slight pressing force is applied to the bit during drilling.

It is therefore an object of the present invention to overcome the above-described problems and to provide an impact drill solving the problems described above.

Specifically, an object of the present invention is to provide an impact drill capable of reducing transmission of the vibration to a user without causing a loss of drilling power.

Another object of the present invention is to provide such an impact drill capable of generating a large amount of repeated impact force at a bit, yet minimizing transmission of a vibration to a handle.

These and other objects of the present invention will be attained by an impact drill for boring a workpiece including a main frame, a motor, a spindle, a first ratchet, a second ratchet, a first spring, and a second spring. The motor is housed in the main frame. The spindle is supported by the main frame and is rotatable by the motor and movable in its axial direction. The first ratchet is rotatable together with the rotation of the spindle and is movable in the axial direction together with the spindle. The second ratchet is positioned in confrontation with the first ratchet and is movable in the axial direction but unrotatable about its axis. Relative rotation between the first ratchet and the second ratchet causes axially reciprocating movement of the spindle in accordance with a repeated abutment between the first ratchet and the second ratchet when the spindle is moved to a first axial position. The first spring is adapted for biasing the second ratchet in a first axial direction. The second spring is adapted for biasing the second ratchet in a second axial direction opposite to the first axial direction.

In another aspect of the invention, there is provided an impact drill for boring a workpiece including a main frame, a motor, a spindle, a first ratchet, a second ratchet, and a damper member. The motor is housed in the main frame. The spindle is supported by the main frame and is rotatable by the motor and movable in its axial direction. The first ratchet is rotatable together with the rotation of the spindle and is movable in the axial direction together with the spindle. The second ratchet is positioned in confrontation with the first ratchet and is movable in the axial direction but unrotatable about its axis. Relative rotation between the first ratchet and the second ratchet causes axially reciprocating movement of the spindle in accordance with a repeated abutment between the first ratchet and the second ratchet when the spindle is moved to a first axial position. The damper member is disposed at the inner peripheral surface of the main frame at a position confrontable with the outer peripheral surface of the second ratchet.

BRIEF DESCRIPTION OF THE DRAWINGS

In the drawings:

FIG. 1(*b*) is a cross-sectional view taken along the line I—I of FIG. 1(*a*);

FIG. 11(*b*) is an enlarged cross-sectional view showing an essential portion in the impact drill according to the third embodiment;

FIG. 14(*b*) is a cross-sectional view taken along the line XIV—XIV of FIG. 14(*a*);

DETAILED DESCRIPTION OF THE PREFERRED EMBODIMENTS

Figure 1A:
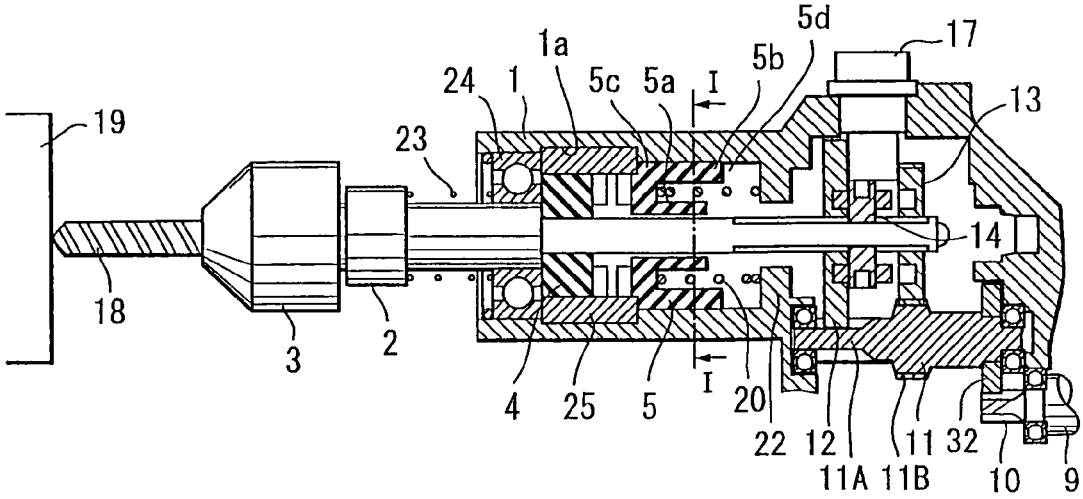
FIG. 1(*a*) is a cross/sectional view showing an impact drill according to a first embodiment of the present invention.

An impact drill according to a first embodiment of the present invention will be described with reference to FIGS. 1 through 5. A main frame 1 supports a spindle 2 by a bearing 24 such that the spindle 2 is movable forward (leftward in the drawing) and backward (rightward in the drawing) with respect to a workpiece 19. A chuck 3 for securing a bit 18 is disposed on a front tip end of the spindle 2. A spindle spring 23 is interposed between the spindle 2 and an inner race of the bearing 24 for normally biasing the spindle frontward (leftward in FIG. 1). An inner end portion of the spindle 2 is provided with a speed changing mechanism described later.

A first ratchet 4 and a second ratchet 5 are provided substantially concentrically with the main frame 1. The first ratchet 4 is rotatable and axially movable along with the rotation and axial displacement of the spindle 2. The first ratchet 4 has one surface having a serrated contour or alternating projections and recesses. The main frame 1 is formed with an annular recess la in which a stop member 25 is provided. A front end of the stop member 25 is in contact with an outer race of the bearing 24. The stop member 25 is sufficiently thick and provides no stress concentration. To this effect, the stop member 25 is preferably made from an elastic material such as a rubber. The outer peripheral surface of the first ratchet 4 is in sliding contact with the inner peripheral surface of the stop member 25. Further, no impacting abutment occurs between the first ratchet 4 and the stop member 25.

The second ratchet 5 includes an inner cylinder 5*a*, an outer cylinder 5*b* and a base wall 5*c* integrally connecting the inner and outer cylinders 5*a* and 5*b* together so as to configure a dual concentrically cylindrical shape. The base wall 5*c* is positioned to a front end of the inner and outer cylinders 5*a*, 5*b*. The front surface of the base wall 5*c* is abuttable on a rear end face of the stop member 25.

Figure 1B:
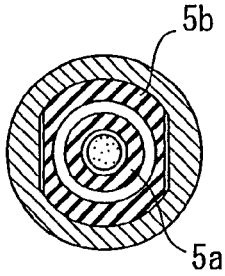

The outer cylinder 5*b* has an axial length greater than that of the inner cylinder 5*a*, and the outer cylinder 5*a* has an inner end face 5*d*. The inner cylinder 5*a* is slidable over the spindle 2. The outer cylinder 5*b* is movable in the axial direction of the spindle 2 and is slidable with respect to an inner peripheral surface of the main frame 1. As shown in FIG. 1(*b*), the outer cylinder 5*b* is formed with a pair of cut away portions, and the inner peripheral surface of the main frame 1 is provided with a pair of complementary increased thickness portions. Thus, the second ratchet 5 is axially movable but non-rotatable about its axis. A cam surface having a serrated contour or alternating projections and recesses is provided at the base wall 5*c*.

A seat wall 22 radially inwardly protrudes from the main frame 1 toward the spindle 2, and a coil spring 20 is interposed between the seat wall 22 and the base wall 5*c*. The spring 20 provides a specific spring constant, so that the inner end face 5*d* of the second ratchet 5 will not come into contact with the seat wall 22 even when the bit 18 is pressed against the workpiece 19.

The speed changing mechanism will be described. A rotary shaft 9 having an output gear 10 is provided to which a rotational driving force from a motor (not shown) is transmitted. A pinion 11 is rotatable about its axis and is supported to the main frame 1 by bearings. A gear 32 is coaxially fixed to the pinion 11 and is meshingly engaged with the output gear 10. The pinion 11 includes a first pinion 11A and a second pinion 11B. A low speed gear 12 in meshing engagement with the first pinion 11A and a high speed gear 13 in meshing engagement with the second pinion 11B are coaxially mounted on the spindle 2. A clutch disc 14 is movably mounted on the spindle 2 and at a position between the low speed gear 12 and the high speed gear 13. The clutch disc 14 is selectively engageable with one of the low speed gear 12 and the high speed gear 13. A change lever 17 is disposed to move the clutch disc 14 to engage one of the low speed gear 12 and the high speed gear 13.

When the change lever 17 moves the clutch disc 14 into the position at which the low speed gear 12 and the spindle 2 engage with each other, the rotational force of the pinion 11 is transmitted to the spindle 2 through the low speed gear 12. As a result, the spindle 2 is rotated at low speed. On the other hand, when the change lever 17 moves the clutch disc 14 into the position at which the high speed gear 13 and the spindle 2 engage with each other, the rotational force of the pinion 11 is transmitted to the spindle 2 through the high speed gear 13. As a result, the spindle 2 is rotated at high speed.

Next, the spring 20 will be described in detail. The present inventors found that ordinarily, a person using an impact drill presses the main frame 1 of the impact drill at a force ranging from 15 to 25 kgf so as to press the bit against the workpiece, despite variations from person to person. In the present embodiment, the spring 20 provides the spring constant capable of avoiding direct contact of the rear end face 5*d* of the second ratchet 105 with the seat wall 22 of the main frame 1 when 15 to 25 kgf of pressing force is applied to the main frame 1. In other words, if the pressing force is within the range of 15 to 25 kgf, the second ratchet 5 is floated away from the main frame 1 by the specific spring constant of the spring 20. Thus, the vibration which will be transmitted to the user as described above can be reduced even during impact drilling mode.

Next, the reasons for the reduction in the vibration passed to the user will be described in detail. In the first embodiment, the second ratchet 5 is in contact with one end of the spring 20, and components other than the second ratchet 5 (hereinafter simply referred to as "a main body") is in contact with the other end of the spring 20. This structure can be expressed as a simple model shown in FIG. 4 in which M represents the main body. If the displacement due to the vibration of the second ratchet 5 is represented as "Zr", and if the displacement of the main body M arising from the vibration of the second ratchet 5 is represented as "Zb", the vibration transmission rate "T" can be expressed as follows.

$$T=|Zb/Zr| \quad (1)$$

In addition, if the vibration frequency of the second ratchet 5 is taken to be "f", and the natural frequency determined from the spring constant and the main body M is taken to be "fc", the transmission rate "T" can be expressed by the following formula.

$$T=|Zb/Zr|=1/|1-(f/fc)^2| \quad (2)$$

Here, if the rotational frequency of the first ratchet 4 is taken to be "N", and the number of projections on each of the first and second ratchets is taken to be "A", then the vibration frequency of the second ratchet 5 can be expressed as N×A. For example, if N=36.7 r.p.s. and A=13, then f is approximately 480 Hz. As is understood from the formula (2), transmission rate of the vibration of the second ratchet 5 to the main body M is reduced if a rate of the vibration frequency f of the second ratchet 5 to the natural frequency fc of the main body M is greater than 1.

Figure 5:
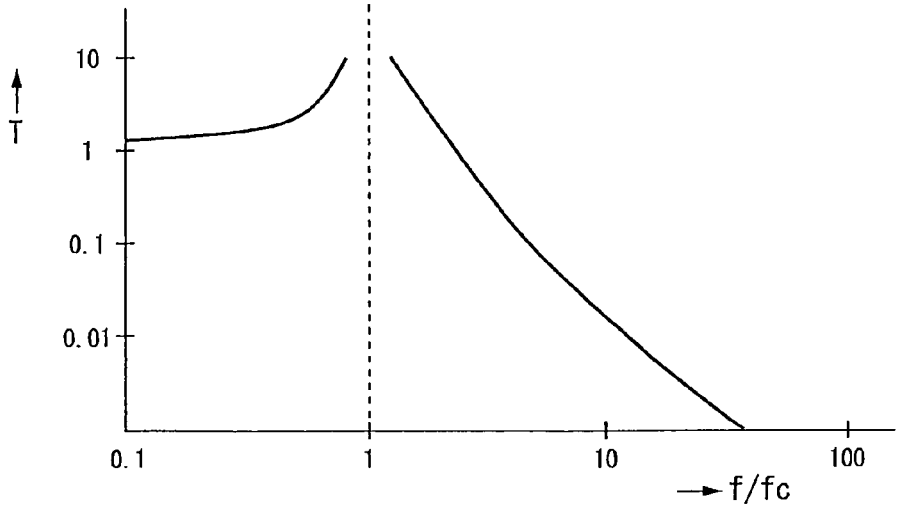
FIG. 5 is a graphical representation showing a characteristic of vibration transmission in the impact drill according to the embodiment.

FIG. 5 shows a logarithmic graph of formula (2). When f/fc=1, T is infinite, and this is a dangerous region in which resonance occurs. However, it can be seen from formula (2) that if f/fc=$\sqrt{2}$ then T=1. If f/fc becomes not less than $\sqrt{2}$ and increased more and more, the smaller the vibration transmission rate T becomes. Experiments have shown that the effects of vibration reduction are sufficient if the vibration transmission rate T is not more than about 0.5. To meet with the vibration transmission rate, f/fc should be larger than approximately 2. Furthermore, if f/fc is larger than 3, then T becomes about 0.1, and the effect is even more obvious.

In operation, FIG. 1 shows the situation in which the pressing force imparted to the main frame 1 is zero, and the first ratchet 4 and the second ratchet 5 are separated from each other. More specifically, when the bit 18 is out of contact from the workpiece 19, the spindle spring 23 interposed between the spindle 2 and the bearing 24 biases the spindle 2 forward (leftward in FIG. 1), and accordingly, the first ratchet 4 moves forward as well. Further, the second ratchet 5 is in abutment with the stop member 25 and maintains its stop position. Meanwhile, the spindle 2 and the first ratchet 4 move forward even further by the biasing force of the spindle spring 23, and move to a position at which the ratchets do not engage with each other. When the pressing force is zero, rotation alone is transmitted to the spindle 2 without generating vibration.

Figure 2:
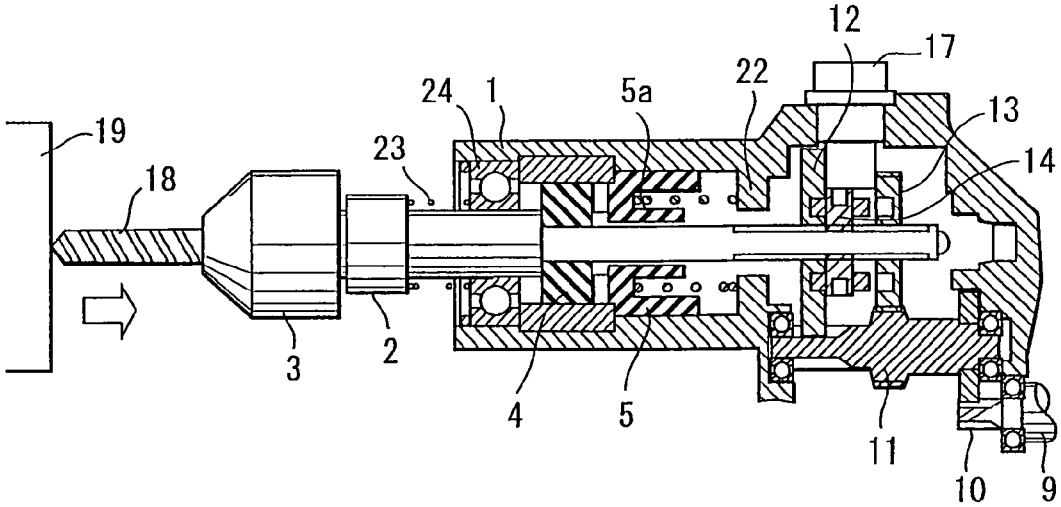
FIG. 2 is a cross-sectional view showing the impact drill and showing a situation where a small pressing force is applied to a bit.

If a small pressing force arises then, the spindle 2 is slightly moved rightward, so that the first ratchet 4 and the second ratchet 5 come into contact with each other, as shown in FIG. 2. Further, in this case, the second ratchet 5 collides against the stop member 25 when there is a relatively small amount of pressing force, and there is a probability that vibration may be transmitted to the main frame 1 through the stop member 25. However, as described above, since the stop member 25 is sufficiently thick and provides no stress concentration and is made from the elastic material, the transmission of vibration can be reduced or dampened by the elastic force and damping effect of the rubber.

Figure 3:
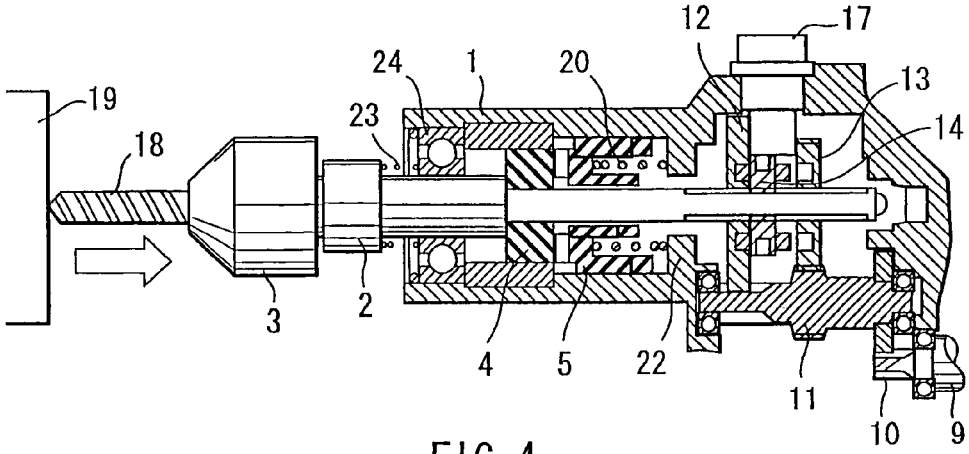
FIG. 3 is a cross-sectional view showing the impact drill and showing a situation where a greater pressing force is applied to the bit.
Figure 4:
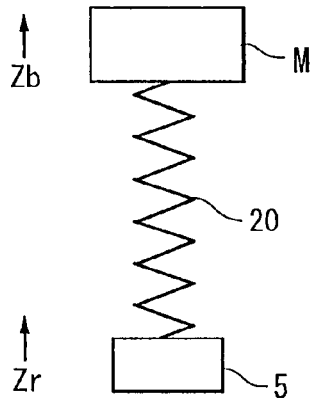
FIG. 4 is a view for description of a transmission of vibration in the impact drill according to the embodiment.

If an even larger pressing force such as ranging from 15 to 25 kg arises, then the spring 20 is compressed, as shown in FIG. 3. Even when a large pressing force arises, the second ratchet 5 nevertheless remains in the floating state, as shown in FIG. 3, since the spring constant of the spring 20 is set at the specific range as described above. In addition, as can be ascertained from FIG. 3, the spindle 2 does not abut against the main frame 1 either.

Because the second ratchet 5 is maintained in its floating phase with respect to the main frame 1 even during the impact drilling mode, transmission of vibration caused from the first and second ratchets 4,5 to the main frame 1 can be reduced. As a result, there is no discomfort imparted on the user of the impact drill, and there is also no need for concern regarding detrimental health effects.

Although the description assumes that the impact drill is turned off, it has been confirmed experimentally that, even during actual drilling, the vibration passed to the hands can be reduced as long as the pressing force is in the range of 15 to 25 kgf.

An impact drill according to a second embodiment of the present invention will next be described with reference to FIGS. 6 to 9 wherein like parts and components are designated by reference numerals added with 100 to those shown in FIGS. 1 through 5 to avoid duplicating description.

In the second embodiment, a member corresponding to the stop member 25 of the first embodiment is dispensed with. Instead, a washer 128 is provided slidably movably along the annular recess 101*a* of the main frame 101 at a position corresponding to the stop member 25. The annular recess 101*a* defines an abutment face 101*b* at its rear end. The washer 128 has an inner diameter greater than an outer diameter of the first ratchet 104 for allowing the first ratchet 104 to enter the washer 128.

The front end of the second ratchet 105 is abuttable on a rear face of the washer 128. Further, a second spring 121 is interposed between the outer race of the bearing 124 and a front face of the washer 128 for biasing the second ratchet 105 away from the first ratchet 104 against the biasing force of the first spring 120. Furthermore, the washer 128 is abuttable on the abutment face 101*b* of the annular recess 101*a*.

Figure 6:
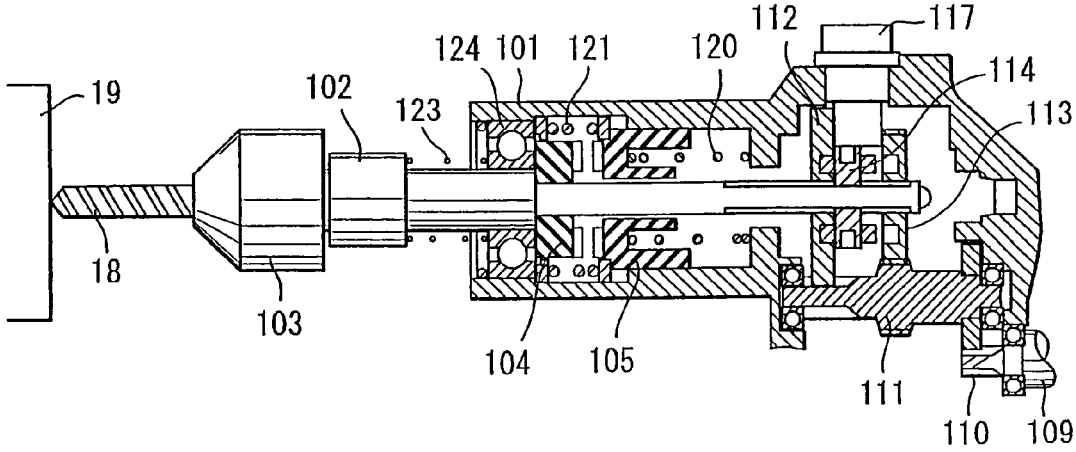
FIG. 6 is a cross-sectional view showing an impact drill according to a second embodiment of the present invention.

With this arrangement, when the pressing force imparted to the main frame 101 is zero as shown in FIG. 6, the spindle 102 moves forward because of the biasing force of the spindle spring 123, and consequently the first ratchet 104 moves forward as well. Further, the second ratchet 105 moves forward to the position at which the force of the first spring 120 and that of the second spring 121 are in equilibrium. The first ratchet 104 and the second ratchet 105 are placed in a separated position from each other by appropriately choosing the spring constants for the springs 120 and 121.

Figure 7:
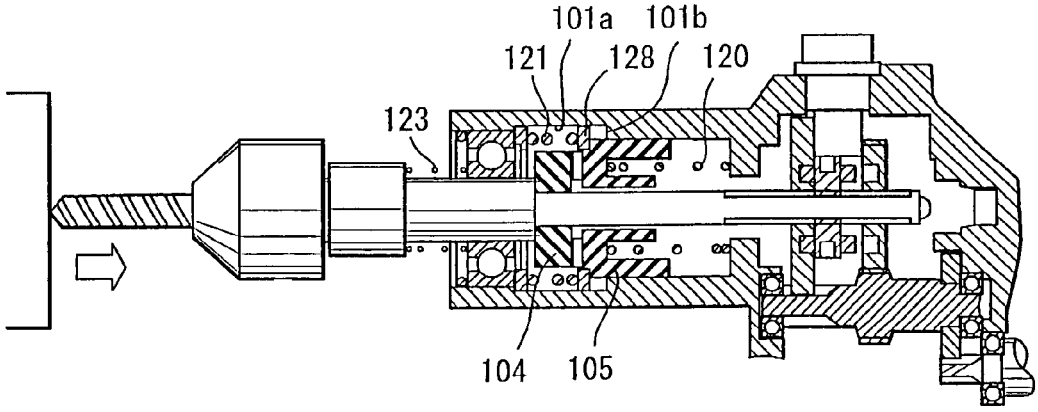
FIG. 7 is a cross-sectional view showing the impact drill according to the second embodiment and showing a situation where a small pressing force is applied to a bit.

Then, as shown in FIG. 7, when a pressure lower than 15 kgf is applied to the main frame 101, extremely small pressing force acts on the spindle 102, and the first ratchet 104 and the second ratchet 105 assume positions in which they are lightly engaged. In this case, the washer 128 is separated from the abutment face 10*b*, and the second ratchet 105 floats completely apart from the main body of the impact drill. As a result, the vibration which is passed to the user is extremely small since the vibration of the second ratchet 105 is not transmitted to the main frame 101 because of the floating. Furthermore, a boring location in the workpiece 19 can be easily set since the fluctuation of the main frame 101 is extremely small.

Figure 8:
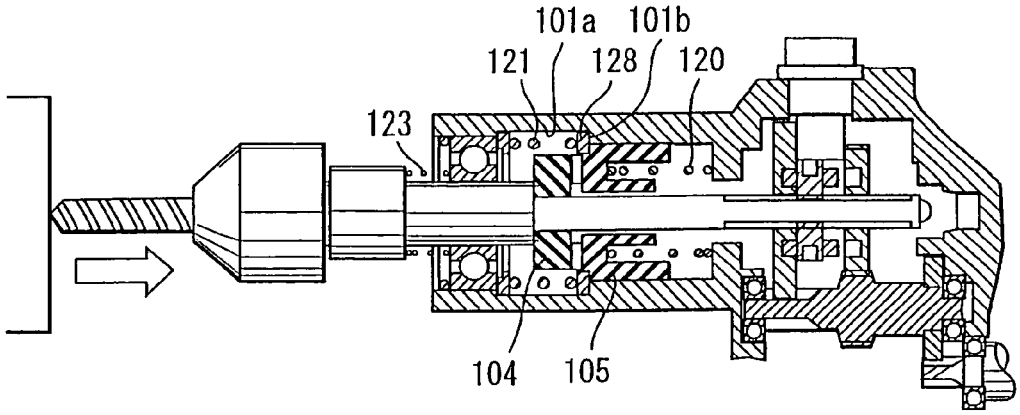
FIG. 8 is a cross-sectional view showing the impact drill according to the second embodiment and showing a situation where an intermediate pressing force greater than the pressing force in FIG. 7 is applied to the bit.

As shown in FIG. 8, proceeding to press slightly more strongly on the main frame 101, the washer 128 is brought into contact with the abutment face 101*b* in the main frame 101. However, this abutment does not cause a significant problem in terms of the impact imparted to the main frame 101. This is mainly because the weight of the washer 128 is extremely light in comparison with the second ratchet 105, and partly because the biasing force of the second spring 121 does not serve as an external force to move the main frame 101, but serves as an internal force on the main frame 101. This has been confirmed experimentally as well.

Figure 9:
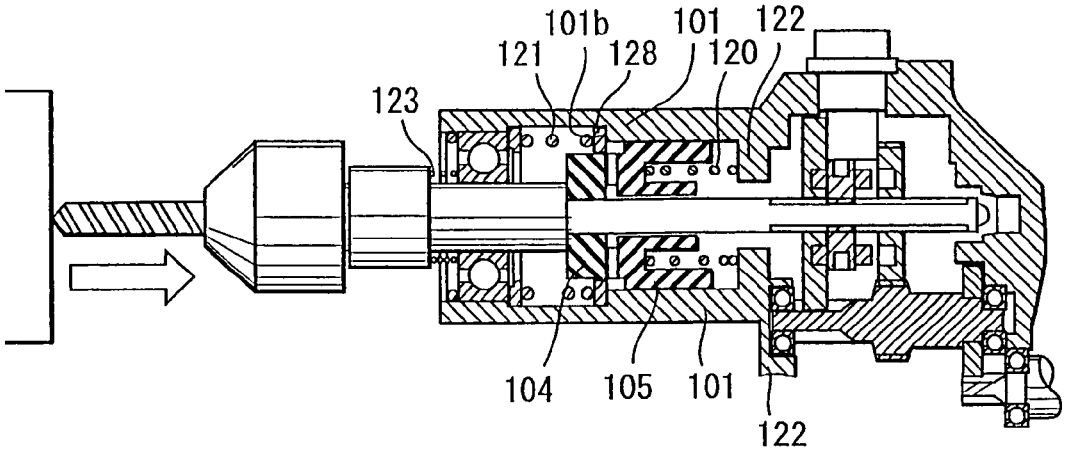
FIG. 9 is a cross-sectional view showing the impact drill according to the second embodiment and showing a situation where a greater pressing force greater than the intermediate pressing force in FIG. 8 is applied to the bit.

As shown in FIG. 9, if the main frame 101 is pressed further strongly with a force ranging from 15 to 25 kfg, the spindle 102 and the first ratchet 104 move backward (rightward in the drawing), while the washer 128 is in abutment with the abutment face 101*b*. If the first ratchet 104 moves even farther backward from this position, then the first ratchet 104 will move backward interlocked together with the second ratchet 105. However, in the same manner as in the first embodiment, with the pressing force ranging from 15 to 25 kgf, the second ratchet 105 still maintains its floating position, i.e., the second ratchet 105 does not abut against the spring seat 122, since the first spring 120 provides the specific spring constant which is large enough that a gap is provided between the second ratchet 105 and the spring seat 122. As a result, the vibration of the second ratchet 105 does not readily pass to the main frame 101, and no discomfort is imparted on the user.

Figure 10:
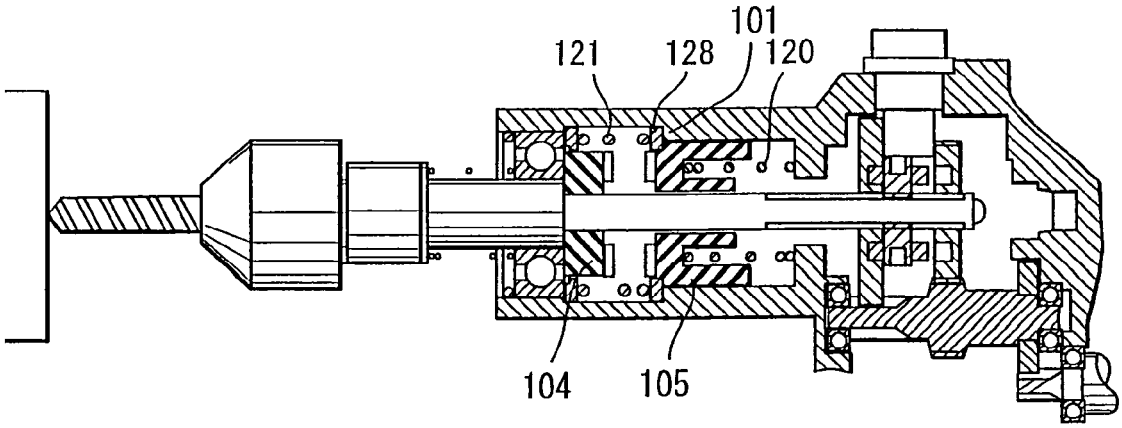
FIG. 10 is a cross-sectional view showing the impact drill according to a modification to the second embodiment and showing a situation where no pressing force is applied to the bit.

FIG. 10 shows a modification to the second embodiment. In the second embodiment, when the pressing force is zero, the second ratchet 105 is held at a given floating position at which the force of the first spring 120 and that of the second spring 121 are balanced with each other as shown in FIG. 6. According to the modification shown in FIG. 10, the second ratchet 105 is held at the position at which the washer 128 is in contact with the abutment face 101*b* when the pressing force is zero. With this arrangement, the stationary position of the second ratchet 105 can be accurately determined. Further, and even with this structure, significant vibration does not occur due to the abutment relation between the washer 128 and the abutment face 101*b* because of the reason described above.

As described above, in the second embodiment and its modified embodiment, since the second spring 121 is provided in addition to the first spring 120, the second ratchet 105 is always maintained in its floating phase with respect to the main frame 101. Consequently, transmission of vibration caused from the first and second ratchets 104, 105 to the main frame 101 can further be reduced. As a result, there is no discomfort imparted on the user of the impact drill, and there is also no need for concern regarding detrimental health effects.

An impact drill according to a third embodiment of the present invention will be described with reference to FIGS. 11(*a*) through 13, wherein like parts and components are designated by reference numerals added with 200 to the reference numerals of the first embodiment.

The third embodiment pertains to a modification to the second embodiment in that a recess 201*a* is formed at a center portion of the main frame 201 in its longitudinal direction. The recess 201*a* is formed with a through hole at its bottom, and a ball member 229 is provided in the recess 201*a*. The ball member 229 can be passed through the through hole. Further, a change-lever 226 is movably disposed over the recess 201*a* and at a position radially outwardly from the ball member 229.

The outer cylinder 205*b* is formed with a groove 205*e* at its outer peripheral surface for receiving the ball member 229. The change-lever 226 has an excitable magnet for attracting the ball member 229. That is, the change-lever 226 is movable to a first position shown in FIG. 11(*b*) where the ball member 229 is attracted to the change lever 226 because of the excitation of the change lever 226 and the ball member 229 is disengaged from the groove 205*e* as shown in FIG. 12 In this state, the second ratchet 205 is separated from the main frame 201. Accordingly, when the spindle 202 rotates, the first ratchet 204 and the second ratchet 205 both rotate, and the impact drill is operated in the drill mode.

Figure 11:
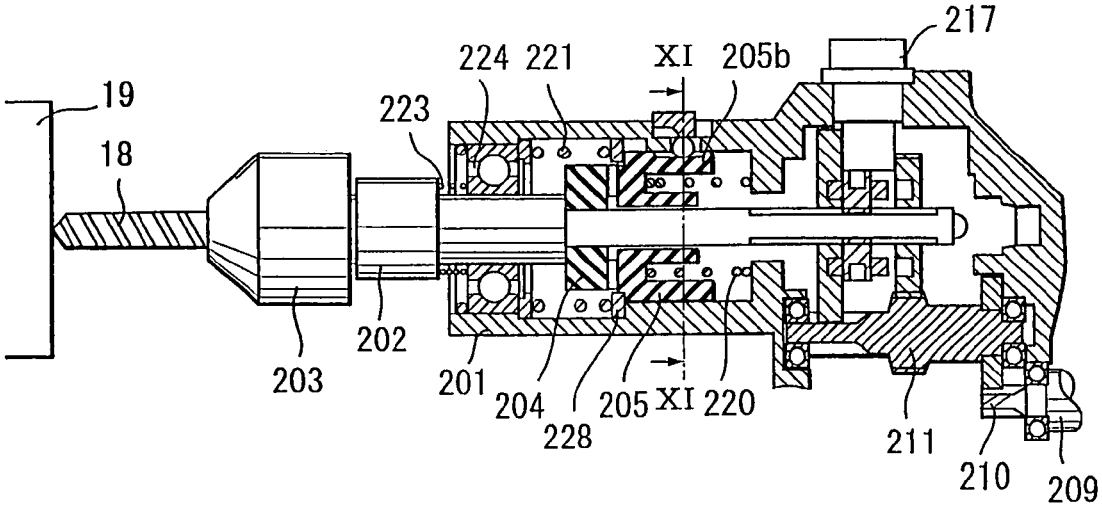
FIG. 11(*a*) is a cross-sectional view showing an impact drill according to a third embodiment of the present invention.
Figure 11:
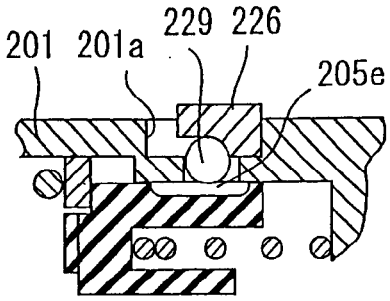
Figure 12:
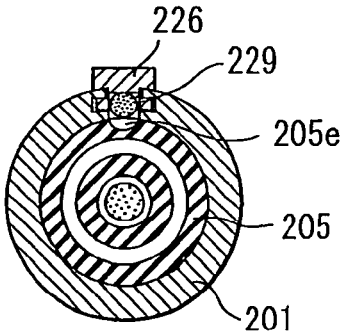
FIG. 12 is a cross-sectional view taken along the line XI—XI of FIG. 11(*a*) and showing a state where a ball is disengaged from a recess.
Figure 13:
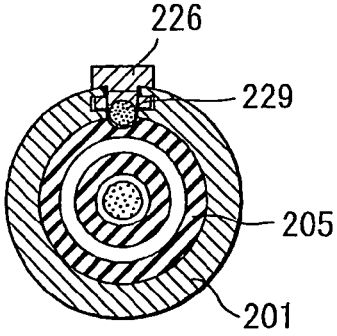
FIG. 13 is a cross-sectional view taken along the line XI—XI of FIG. 11(*a*) and showing a state where the ball is engaged with the recess.

On the other hand, if the change-lever 226 is switched to non-excited phase while moving to a second position shown in FIG. 11(*a*), the ball member 229 is pressed radially inwardly by the change-lever 226 to engage the groove 205*e* as shown in FIG. 13. In this state, the second ratchet 205 is coupled to the main frame 201. As a result, when the spindle 202 rotates, the first ratchet 204 rotates together with the rotation of the spindle 202, whereas the second ratchet 205 does not rotate. Therefore, due to the serrated contoured surfaces between the first and second ratchets 204 and 205, a repeated striking force is generated, and the impact drill operates in impact drilling mode.

In the third embodiment, the second ratchet 205 maintains its floating position in drilling mode as well as impact drilling mode. Furthermore, the vibration passed to the user can be reduced since the vibration caused by the first and second ratchets 204 and 205 is not readily transferred to the main frame 201. In addition, the frictional force acting between the second ratchet 205 and the outer cylinder 205*b* can be reduced by the rolling of the ball member 229. Therefore, friction loss can be reduced.

Figure 14A:
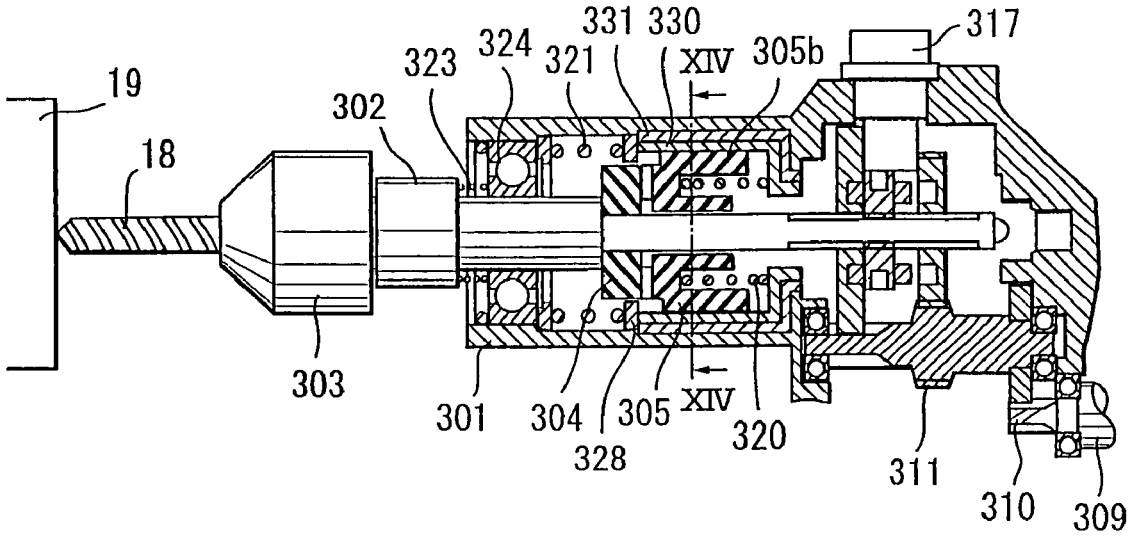
FIG. 14(*a*) is a cross-sectional view showing an impact drill according to a fourth embodiment of the present invention.
Figure 14B:
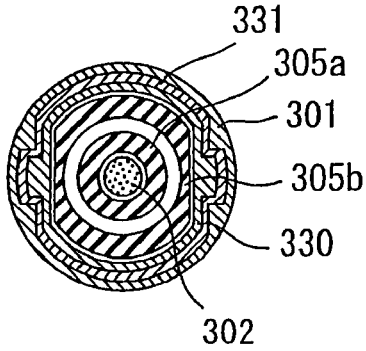
Figure 15:
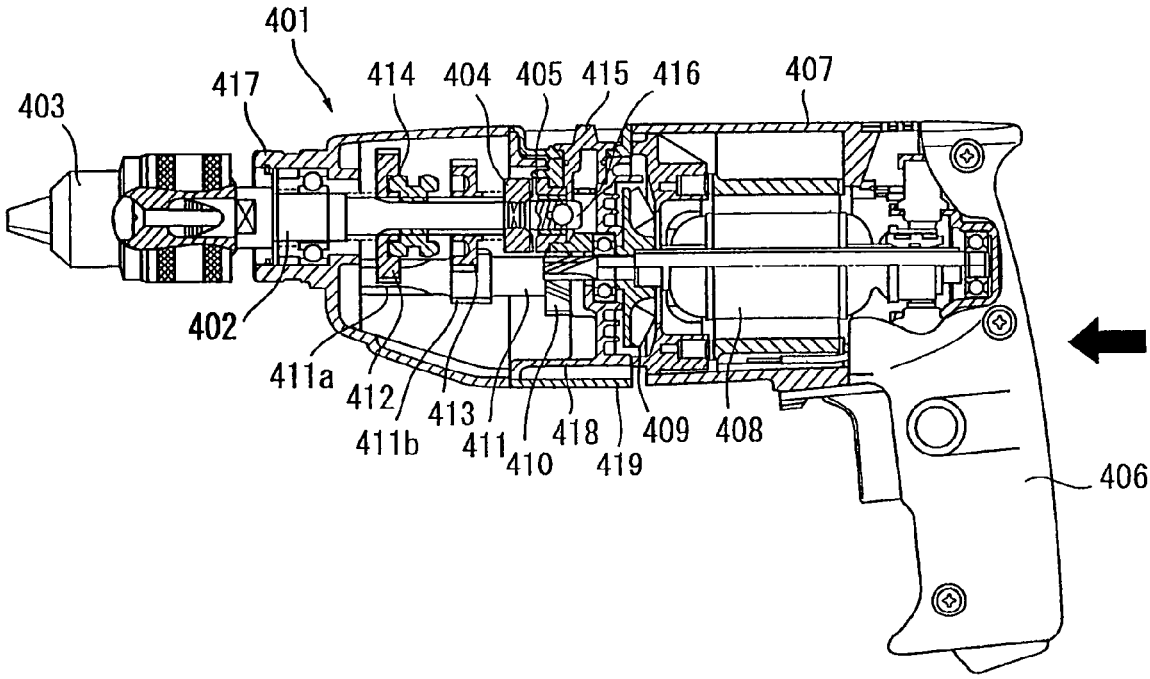
FIG. 15 PRIOR ART
FIG. 15 is a cross-sectional view showing a conventional impact drill.
Figure 16:
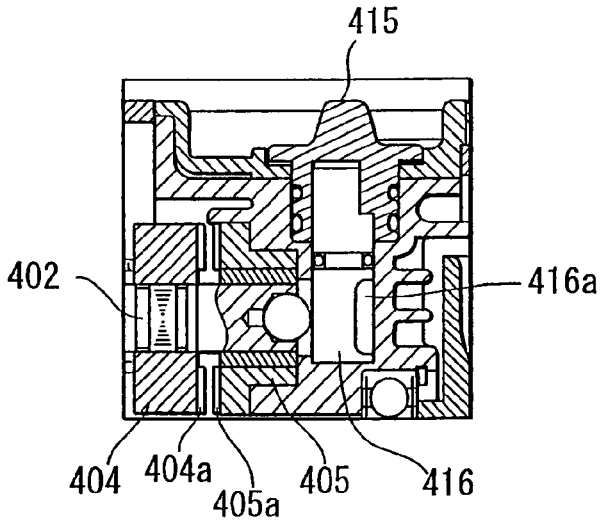
FIG. 16 PRIOR ART
FIG. 16 is an enlarged cross-sectional view showing an essential portion of FIG. 15 for description of a drilling mode.
Figure 17:
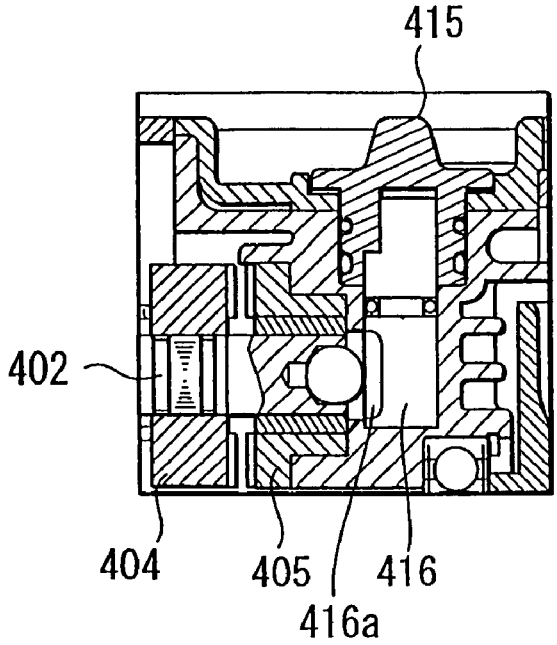
FIG. 17 PRIOR ART
FIG. 17 is an enlarged cross-sectional view showing the essential portion of FIG. 15 for description of a starting phase of an impact drilling mode.
Figure 18:
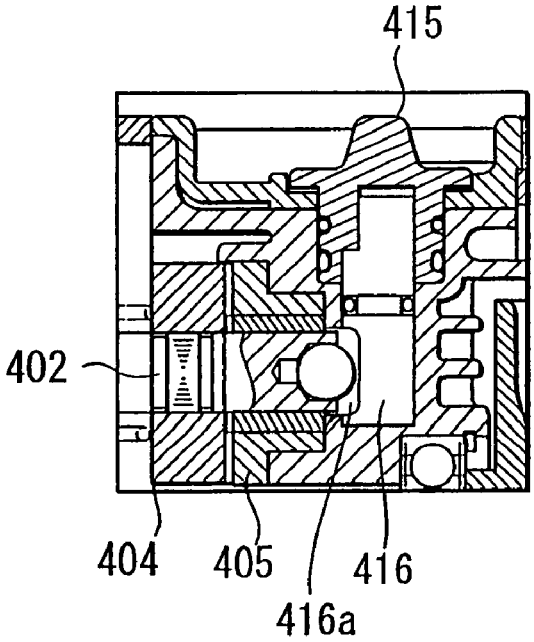
FIG. 18 PRIOR ART
FIG. 18 is an enlarged cross-sectional view showing the essential portion of FIG. 15 for description of the impact drilling mode.
Figure 19:
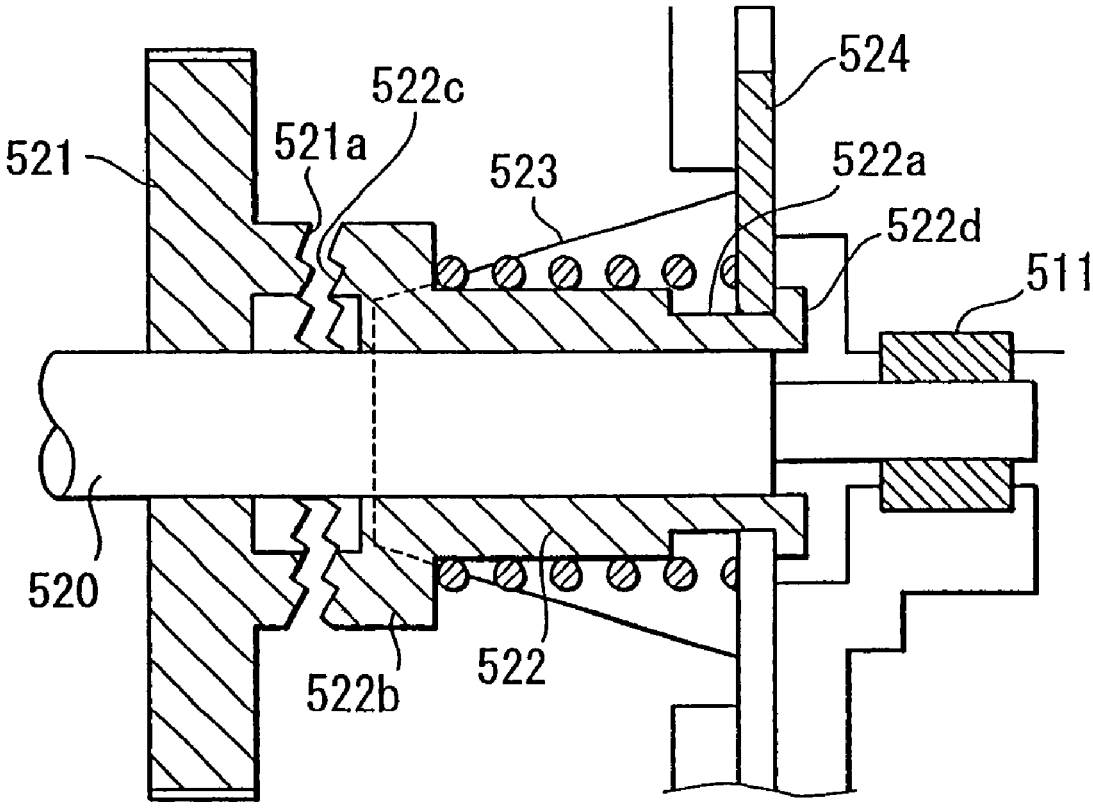
FIG. 19 PRIOR ART
FIG. 19 is a cross-sectional view showing an essential portion of another conventional impact drill.

FIGS. 14(*a*) and 14(*b*) show an impact drill according to a fourth embodiment of the present invention, wherein like parts and components are designated by reference numerals added with 300 to those of the first embodiment.

In the fourth embodiment, an elastic sleeve member 331 is disposed at an inner peripheral surface of the main frame 301 at a position in confrontation with the outer cylinder 305*b*. Further, a ratchet holder 330 is disposed at an inner peripheral surface of the elastic sleeve member 331 for surrounding the outer cylinder 305*b*. The ratchet holder 330 is adapted for preventing the second ratchet 305 from rotating about its axis.

Similar to the foregoing embodiments, the vibration of the second ratchet 305 become less readily passed to the user because the first spring 320 is interposed between the second ratchet 305 and the main frame 301 so as to floatingly maintain the second ratchet 305. Further, because the elastic sleeve member 331 is interposed between the ratchet holder 330 and the main frame 301, the vibration passed to the user can be reduced even further because of the buffering function of the elastic sleeve member 331.

While the invention has been described in detail with reference to specific embodiments thereof, it would be apparent to those skilled in the art that various changes and modifications may be made therein without departing from the spirit and scope of the invention.

What is claimed is:

1. An impact drill for boring a workpiece comprising:

a main frame;

a motor housed in the main frame;

a spindle supported by the main frame and rotatable by the motor and movable in its axial direction;

a first ratchet rotatable together with the rotation of the spindle and movable in the axial direction together with the spindle;

a second ratchet positioned in confrontation with the first ratchet and movable in the axial direction but unrotatable about its axis, wherein repeated abutment between the first ratchet and the second ratchet when the spindle is moved to a first axial position causes axially reciprocating movement in the spindle;

a first spring biasing the second ratchet in a first axial direction; and a second spring biasing the second ratchet in a second axial direction opposite to the first axial direction.

2. The impact drill as claimed in claim 1, wherein the second ratchet has a front side and a rear side, and wherein the first spring is interposed between the main frame and the rear side for urging the second ratchet toward the first ratchet, the first spring having a spring constant capable of preventing the second ratchet and the spindle from abutting against the main frame when a force ranging from 15 to 25 kg is applied to the main frame for boring the workpiece.

3. The impact drill as claimed in claim 2, wherein the second spring is interposed between the main frame and the front side when no force is applied to the spindle from the workpiece for urging the second ratchet in a direction away from the first ratchet, whereby the second ratchet is resiliently held by the main frame through the first spring and the second spring.

4. The impact drill as claimed in claim 3, wherein the second spring has one end seated on the main frame and another end separated from the main frame.

5. The impact drill as claimed in claim 3, wherein the second spring has one end seated on the main frame and another end seated on the main frame and associated with the second ratchet when no force is applied to the spindle from the workpiece.

6. The impact drill as claimed in claim 3, wherein the second spring has one end seated on the main frame and another end seated on the main frame for permitting the second spring to disengage from the second ratchet when a force ranging from 15 to 25 kg is applied to the main frame, whereby the second ratchet is only biased by the first spring.

7. The impact drill as claimed in claim 3, further comprising a spindle spring interposed between the main frame and the spindle for normally urging the spindle in a direction to protrude out of the main frame.

8. The impact drill as claimed in claim 1, wherein f/fc is not less than 2, in which f represents a vibration frequency of the second ratchet, and fc represents a natural frequency determined by components including the main frame and excluding the second ratchet and by the spring constant of the first spring.

9. The impact drill as claimed in claim 8, wherein f/fc is not less than 3.

10. An impact drill for boring a workpiece comprising:

a main frame having an inner peripheral surface;

a motor housed in the main frame;

a spindle supported by the main frame and rotatable by the motor and movable in its axial direction;

a first ratchet rotatable together with the rotation of the spindle and movable in the axial direction together with the spindle;

a second ratchet positioned in confrontation with the first ratchet and movable in the axial direction but unrotatable about its axis, the second ratchet having an outer peripheral surface, wherein repeated abutment between the first ratchet and the second ratchet when the spindle is moved to a first axial position causes axially reciprocating movement of the spindle; and a damper member disposed between the main frame and the outer peripheral surface of the second ratchet.

11. The impact drill as claimed in claim 10, wherein the second ratchet has a front side and a rear side, and the impact drill further comprising a first spring interposed between the main frame and the rear side for biasing the second ratchet in a first axial direction.

12. The impact drill as claimed in claim 11, further comprising a second spring biasing the second ratchet in a second axial direction opposite to the first axial direction.

13. The impact drill as claimed in claim 12, wherein the first spring provides a spring constant capable of preventing the second ratchet and the spindle from abutting against the main frame when a force ranging from 15 to 25 kg is applied to the main frame for boring the workpiece.

14. The impact drill as claimed in claim 12, wherein the second spring is interposed between the main frame and the front side.

15. The impact drill as claimed in claim 14, wherein the second spring is interposed between the main frame and the front side when no force is applied to the spindle from the workpiece for urging the second ratchet in a direction away from the first ratchet, whereby the second ratchet is resiliently held by the main frame through the first spring and the second spring.

16. (currently amended) The impact drill as claimed in claim 12, further comprising a spindle spring interposed between the main frame and the spindle for urging the spindle in a direction to protrude out of the main frame.

* * * * *